US009874187B2

(12) United States Patent
Kurt et al.

(10) Patent No.: US 9,874,187 B2
(45) Date of Patent: Jan. 23, 2018

(54) HOLD-DOWN DEVICE FOR A FUEL INJECTION DEVICE

(71) Applicant: Robert Bosch GmbH, Stuttgart (DE)

(72) Inventors: Serkan Kurt, Bursa (TR); Ersin Dogan, Ludwigsburg (DE); Umit Centez, Izmir (TR)

(73) Assignee: ROBERT BOSCH GMBH, Stuttgart (DE)

( * ) Notice: Subject to any disclaimer, the term of this patent is extended or adjusted under 35 U.S.C. 154(b) by 5 days.

(21) Appl. No.: 15/022,123

(22) PCT Filed: Jul. 24, 2014

(86) PCT No.: PCT/EP2014/065893
§ 371 (c)(1),
(2) Date: Jun. 22, 2016

(87) PCT Pub. No.: WO2015/039789
PCT Pub. Date: Mar. 26, 2015

(65) Prior Publication Data

US 2016/0319790 A1 Nov. 3, 2016

(30) Foreign Application Priority Data

Sep. 19, 2013 (DE) ..... 10 2013 218 824

(51) Int. Cl.
*F02M 61/14* (2006.01)
*F02M 55/02* (2006.01)
*F02M 55/00* (2006.01)

(52) U.S. Cl.
CPC ..... *F02M 61/14* (2013.01); *F02M 55/004* (2013.01); *F02M 55/025* (2013.01);
(Continued)

(58) Field of Classification Search
CPC .... F02M 61/14; F02M 55/004; F02M 55/025; F02M 2200/853; F02M 2200/8023;
(Continued)

(56) References Cited

U.S. PATENT DOCUMENTS 4,294,215 A 10/1981 Hans et al.
5,074,269 A * 12/1991 Herbon ..... F02M 55/004 123/456
(Continued)

FOREIGN PATENT DOCUMENTS

EP 1 892 408 A1 2/2008
FR 2 372 393 A1 6/1978
(Continued)

*Primary Examiner* — Hai Huynh
(74) *Attorney, Agent, or Firm* — Norton Rose Fulbright US LLP; Gerard Messina

(57) ABSTRACT

A hold-down device for a fuel injection device includes at least one fuel injector and a fuel distributor line, the hold-down device being clampable between the fuel injector and the fuel distributor line, the hold-down device having a partially ring-shaped base element, from which two axially flexible hold-down clips extend, in which the partially ring-shaped base element and the two axially flexible hold-down clips are formed together by a single bent wire.

19 Claims, 3 Drawing Sheets

(52) U.S. Cl.
CPC ..... *F02M 2200/8023* (2013.01); *F02M 2200/853* (2013.01); *F02M 2200/856* (2013.01); *F02M 2200/9053* (2013.01)

(58) Field of Classification Search
CPC ..... F02M 2200/9053; F02M 2200/856; F02M 2200/857; F02M 2200/855
USPC ..... 123/470
See application file for complete search history.

(56) References Cited

U.S. PATENT DOCUMENTS 5,501,195 A * 3/1996 Hall ..... F02M 61/145 123/470
5,970,953 A * 10/1999 Lorraine ..... F02M 61/14 123/456
6,681,458 B2 * 1/2004 Seymour ..... H01R 13/6335 24/634
7,802,559 B2 * 9/2010 Furst ..... F02M 61/14 123/470
8,707,930 B2 3/2014 Bolz et al.
9,541,047 B2 * 1/2017 Pohlmann ..... F02M 61/14

FOREIGN PATENT DOCUMENTS

FR 2 450 357 A1 9/1980
JP 2004-340208 A 12/2004

* cited by examiner

HOLD-DOWN DEVICE FOR A FUEL INJECTION DEVICE

FIELD OF THE INVENTION

The present invention is directed to a hold-down device for a fuel injection device.

BACKGROUND INFORMATION

Hold-down devices and such fuel injection devices are already believed to be understood from the related art, including for example, DE 10 2008 002 122 A1.

The hold-down device in DE 10 2008 002 122 A1 is made or manufactured, for example, by stamping out and bending.

SUMMARY OF THE INVENTION

The hold-down device according to the present invention for a fuel injection device including the characterizing features described herein has the advantage that it has a further simplified design and is in particular simple and cost-effective to manufacture. For manufacturing the hold-down device, it is only necessary to create pieces of the used wire of the desired length at minimum expense and bring them into the shape according to the present invention by bending.

Furthermore, the design made from wire according to the present invention ensures that the hold-down device has improved strength with low material usage and a more uniform distribution of the stresses acting in the hold-down device to the entire component.

Refinements of the present invention ensue from the subclaims and the exemplary embodiment.

It is advantageous if the base element of the hold-down device may be placed onto a shoulder of a fuel injector, in particular in a planar manner.

It is advantageous if the contact segments of the hold-down clip may be placed into contact with the fuel distributor line, in particular in a planar manner.

It is advantageous if the two contact segments of the hold-down clip terminate it in the direction of the wire, so that the hold-down device is open.

It is advantageous if the bent wire is a square-shaped wire, in particular, having a square cross section.

The wire may, for example, have a cross-sectional area of 1 square millimeter through 9 square millimeters, which may be 5.76 square millimeters and/or be made of 1.4310 high-grade steel or C75S steel having a zinc flake coating. In principle, other materials, in particular, stainless steels and/or spring steels may be used.

DETAILED DESCRIPTION

Figure 1:
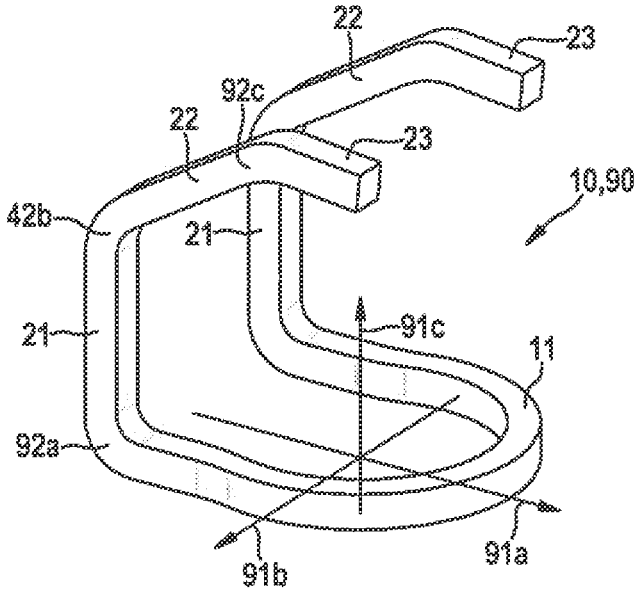
FIG. 1 shows a specific embodiment according to the present invention of a hold-down device in a perspective view.

As an exemplary embodiment of the present invention, a hold-down device 10 is shown in FIG. 1, which may be part of a fuel injection system as is in principle already known, for example, from DE 10 2008 002 122 A1, and thus solely its exemplary design is referred to here.

Hold-down device 10 is provided to be clamped between a fuel injector and a fuel distributor line and has a partially ring-shaped base element 11, in the example an approximately semi ring-shaped base element 11, which in the figure lies in the base plane spanned by an arrow 91*a* in the direction of opening of partially ring-shaped base element 11 and an additional arrow 91*b*. Partially ring-shaped base element 11 may be placed onto a shoulder of the fuel injector.

From each of the two ends of partially ring-shaped base element 11 pointing in the circumferential direction, a hold-down clip 13 extends, which has a certain flexibility in the axial direction (parallel to arrow 91*c*, perpendicular to the base plane). Hold-down clips 13 are formed mirror-inverted to one another.

Both hold-down clips 10 have three segments each, a web 21, an oblique segment 22 and a contact segment 23.

Web 21 is in each case connected to one end of partially ring-shaped base element 11 via a fillet 92*a* and points in the axial direction (parallel to arrow 91*c*, perpendicular to the base plane).

Oblique segment 22 is connected to web 21 via a fillet 92*b*, is situated on the side of web 21 which is diametrically opposed to base element 11 and is at an angle from web 21 at an angle of approximately 60° in a direction opposed to the direction of opening of partially ring-shaped base element 11 (thus in the direction of arrow 91*a*).

Contact segment 23 is connected to oblique segment 22 via a fillet 92*b*, is situated on the side of web 21 diametrically opposed to base element 11 and points in a direction opposed to the direction of opening of partially ring-shaped base element (thus in the direction of arrow 91*a*). Contact segments 23 of hold-down clip 13 terminate it, so that hold-down device 10 is open on two sides.

Hold-down device 10 is formed from a bent wire 90, which in this example is a square-shaped wire having a generally square cross section. Its cross-sectional area amounts to 5.76 square millimeters and it is made of 1.4310 high-grade steel. Here, the straight lateral edges of the square-shaped wire point in the axial direction (arrow 91*c*) and opposite to it, making it possible for the hold-down device to come into contact with the fuel injector and the fuel distributor line in a planar manner.

In FIGS. 2*a* through 2*e*, another exemplary embodiment of the present invention is shown from various perspectives. It is characterized in that not only the base element but also hold-down clip 13 has a shape curved in the radial direction. In this way, the integration of hold-down device 10 into a fuel injection device reduces the installation space requirements compared to the first exemplary embodiment.

The additional exemplary embodiment differs from the first exemplary embodiment shown in FIG. 1 by a modified design as provided in the details below.

It includes a partially ring-shaped base element 11, in this example a base element 11 in the shape of somewhat more than a semicircle which, for example, encompasses 210° of a circular arc.

Figure 2A:
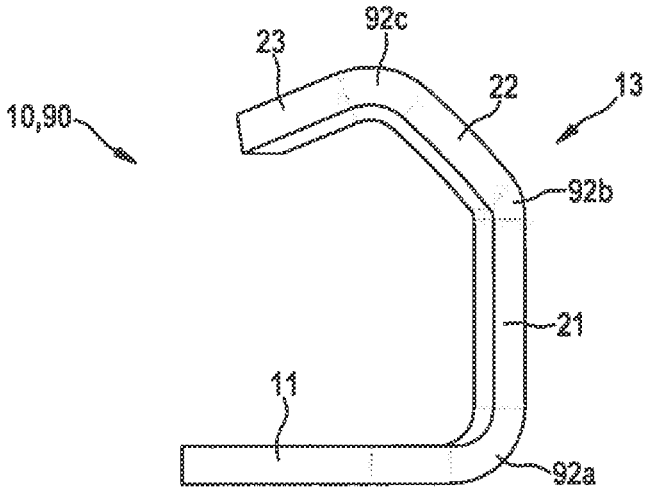
FIGS. 2*a*, 2*b*, 2*c*, 2*d*, and 2*e* show another specific embodiment according to the present invention of a hold-down device in various views.
Figure 2B:
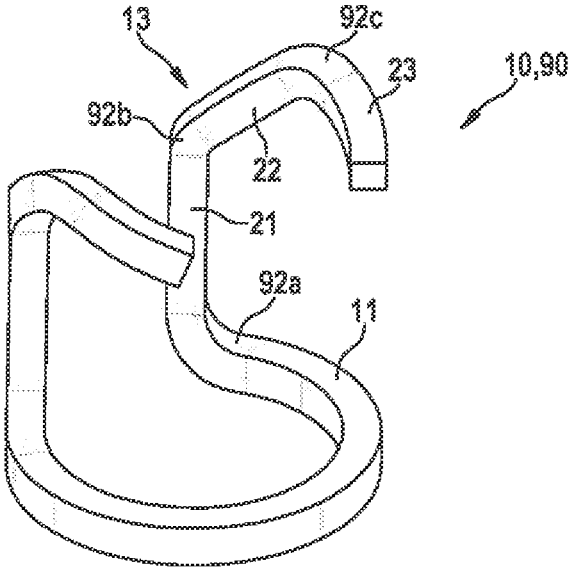
Figure 2C:
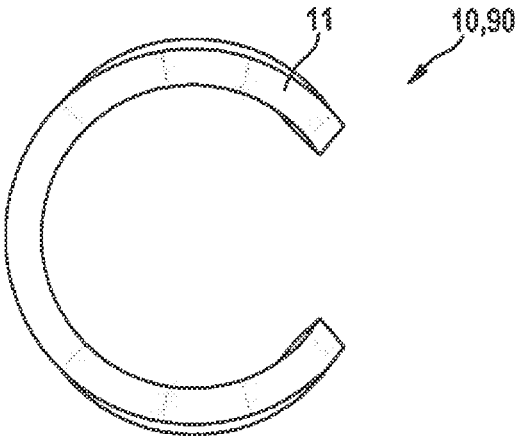
Figure 2D:
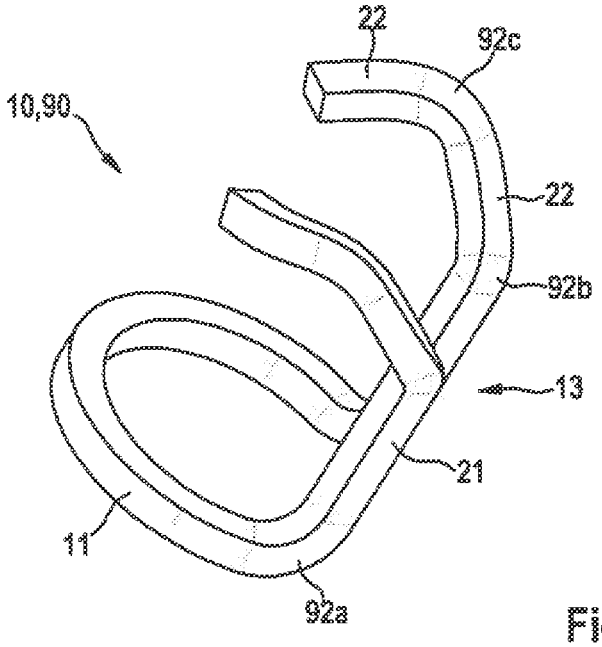
Figure 2E:
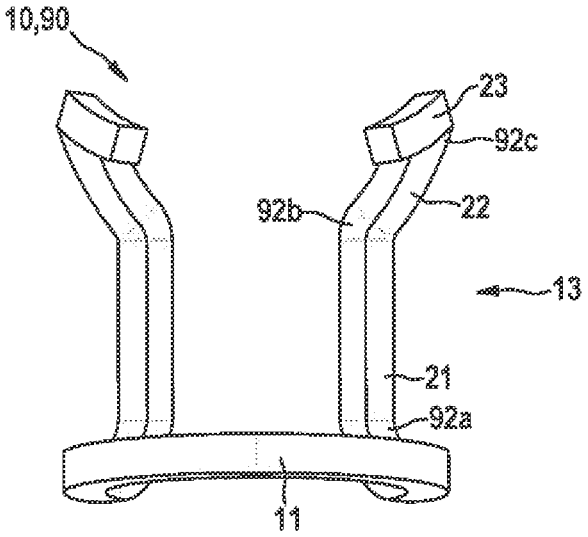

In this embodiment, oblique segment 22 is configured to be slightly radially curved, so that in an axial top view (top view of the base element, FIG. 2*c*), it coincides at least approximately with base element 11 or fillet 92*a*. Likewise, the segments situated distally from oblique segment 22, fillet segment 92*c* and contact segment 23, are configured to be radially curved, so that in this example in an axial top view (top view of the base element, FIG. 2*c*), they coincide at least approximately with base element 11. Fillet segment 92*c* is moreover also curved in the axial direction to such a degree that adjoining contact segment 23 in axial direction points back into the direction in which the base element lies (FIG. 2*a*, bottom).

In this example also, hold-down device 10 is formed from a bent wire 90, which in this example is a square-shaped wire having a generally square cross section. Its cross-sectional area amounts to 5.76 square millimeters and it is made of 1.4310 high-grade steel in this example also.

What is claimed is:

1. A hold-down device for a fuel injection device, which includes at least one fuel injector and a fuel distributor line, comprising:

a partially ring-shaped base element, from which two axially flexible hold-down clips extend;

wherein the partially ring-shaped base element and the two axially flexible hold-down clips are formed together by a single bent wire, and wherein the hold-down device is clampable between the fuel injector and the fuel distributor line, the base element being place-able onto a shoulder of the fuel injector, and the hold-down clips being place-able into contact with the fuel distributor line.

2. The hold-down device of claim 1, wherein the hold-down clips each have at least one web, an oblique segment and a contact segment.

3. The hold-down device of claim 2, wherein the two contact segments of the hold-down clip terminate it, so that the hold-down device is open.

4. The hold-down device of claim 1, wherein the bent wire is a square-shaped wire.

5. The hold-down device of claim 1, wherein the bent wire has a cross-sectional area of 1 square millimeter to 9 square millimeters.

6. The hold-down device of claim 1, wherein the bent wire is made from at least one of: stainless steel, spring steel, or 1.4310 high-grade steel.

7. The hold-down device of claim 1, wherein, in a top view of hold-down device, at least one of the hold-down clips is covered by the partially ring-shaped base element and/or covers the partially ring-shaped base element at least partially.

8. The hold-down device of claim 1, wherein the bent wire is a square-shaped wire having a square cross section.

9. The hold-down device of claim 1, wherein the bent wire has a cross-sectional area of between 1 and 9 square millimeters.

10. The hold-down device of claim 1, wherein the base element lies in a base plane, and each of the hold-down clips includes a section extending perpendicular to the base plane.

11. The hold-down device of claim 10, wherein each of the hold-down clips includes a second section extending at an angle from the section extending perpendicular to the base plane.

12. The hold-down device of claim 1, wherein each of the hold-down clips includes a contact segment pointing in a direction opposite to an opening in the base element.

13. The hold-down device of claim 1, wherein the base element includes at least a semi circular ring shape portion.

14. The hold-down device of claim 1, wherein the base element includes at least 210° of a circular arc.

15. The hold-down device of claim 1, wherein the base element lies in a base plane, the wire includes a square cross section, first straight sides of the cross section are parallel with the base plane, and second straight sides of the cross section are perpendicular to the base plane.

16. The hold down-device of claim 1, wherein each of the hold-down clips has a web segment connected to the base element via a fillet and an oblique segment connected to the web segment via a fillet.

17. The hold-down device of claim 16, wherein the oblique segment is curved.

18. The hold down-device of claim 16, wherein each of the hold-down clips has a contact segment connected to the oblique segment via a fillet.

19. The hold-down device of claim 16, wherein the contact segment is curved.

* * * * *